US005208633A

United States Patent [19]

Genovese

[11] Patent Number: 5,208,633

[45] Date of Patent: May 4, 1993

[54] BELT POSITION SENSING FOR IMAGE REGISTRATION

[75] Inventor: Frank C. Genovese, Fairport, N.Y.

[73] Assignee: Xerox Corporation, Stamford, Conn.

[21] Appl. No.: 812,083

[22] Filed: Dec. 23, 1991

[51] Int. Cl.[5] ..... G03G 5/00

[52] U.S. Cl. ..... 355/212; 226/15; 226/18; 226/20; 355/203; 355/208

[58] Field of Search ..... 355/212, 213, 208, 204, 355/205, 207, 67, 70, 200, 202, 203; 226/15, 18, 20, 21

[56] References Cited

U.S. PATENT DOCUMENTS

| | | | |
|---|---|---|---|
| 4,407,438 | 10/1983 | Wiechmann | 226/20 X |
| 4,485,982 | 12/1984 | St. John et al. | 226/20 X |
| 4,959,688 | 9/1990 | Koitabashi | 355/219 |

FOREIGN PATENT DOCUMENTS

| | | | |
|---|---|---|---|
| 0073561 | 4/1985 | Japan | 355/212 |
| 0297671 | 11/1989 | Japan | 355/212 |
| 1388373 | 4/1988 | U.S.S.R. | 226/20 |

*Primary Examiner*—A. T. Grimley

*Assistant Examiner*—Matthew S. Smith

*Attorney, Agent, or Firm*—Mark Costello

[57] ABSTRACT

In an imaging device having a belt supporting image on an image supporting surface and moving along an endless path in a process direction, an exposure device for forming images on the image supporting surface, an arrangement is provided to derive information about belt position with respect to the exposure device. The belt is provided with at least one fiducial opening or target at a belt edge, and a sensor is arranged with respect to the belt and the fiducial opening, to sense illumination directed through the fiducial opening. An illumination source is provided at a fixed position with respect to the exposure device and the sensor to directing illumination to the sensor, when the fiducial opening is aligned with the sensor, including at least two independently detectable illumination sources arranged along a cross process direction. Belt position with respect to the exposure device is then determined from the amount of occlusion of one of the first and second independently detectable illumination sources. Control of belt position may be split between image processing methods and mechanical methods.

20 Claims, 5 Drawing Sheets

BELT POSITION SENSING FOR IMAGE REGISTRATION

This invention relates to multiple image reproduction apparatus, and more particularly, to an apparatus for controlling the placement of successive images on a photoreceptor belt.

BACKGROUND OF THE INVENTION

In certain electrophotographic applications such as color xerography, a charge retentive surface moving in a process direction is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder or powder suspension referred to as "toner". Toner is held on the image areas by the electrostatic charge on the surface. Subsequently, a second image can be formed over the first image, by providing a re-charge station, a second exposure station and a second development arrangement. Subsequent extension of this basic process can be understood to form the basis for producing multiple color images. Conveniently, an LED bar, an array of light emitting diodes arranged in a linear array and extending across the charge retentive surface, transverse to the process direction may be used as an exposure device. However, such an arrangement has no intrinsic built-in means for compensating for uncontrolled travel or mechanical drift of the charge retentive surface (commonly a belt) in the cross process direction. This becomes especially important for color images where misregistration of the different colors by as little as a fraction of a pixel width can seriously detract from image quality.

SUMMARY OF THE INVENTION

In accordance with the invention there is provided an arrangement to sense illumination directed through fiducial openings formed in the charge retentive surface of a belt, where variations of sensed illumination are indicative of belt travel in a cross process direction.

In accordance with one aspect of the invention, an imaging device is provided with a belt member supporting images on an image supporting surface moving along an endless path in a process direction, an exposure device for forming images on the image supporting surface and means for maintaining the belt in registration with the exposure device, the registration means comprising: the belt member provided at least one fiducial opening formed therein; a sensor disposed with respect to the belt member and at least one of the fiducial openings, to sense illumination directed through the fiducial opening in the belt member; means at a fixed position with respect to the exposure device and the sensor for directing illumination therethrough, including at least first and second independently detectable illumination sources arranged along a cross process direction; and means for determining belt position with respect to the exposure device from the amount of occlusion of one of the first and second independently detectable illumination sources.

In accordance with another aspect of the invention, an electrophotographic device of the type contemplated by the present invention includes a belt having a charge retentive surface, driven in a process direction along an endless path through a series of processing stations that create a latent image on the charge retentive surface, develop the image with toner, and bring a sheet of paper or other transfer member into intimate contact with the charge retentive surface at a transfer station for electrostatic transfer of toner from the charge retentive surface to the sheet. The device includes at least one exposure station including an LED print bar exposure device, which is driven in accordance with a stored electronic image to imagewise expose the charge retentive surface. A pair of fiducial openings are formed in the belt, at inboard and outboard edges thereof, at common positions in the process direction. The LED print bar is driven so that a selected group of LED's at an inboard and a selected group of LED's at an outboard position corresponding to the fiducial openings direct light through the openings. A pair of sensors is arranged to sense illumination directed through the fiducial openings. As the belt travels in the cross process direction, the amount of illumination varies at one sensor or the other, dependent on the occlusion of the selected LED's by the moving belt.

Each selected group of LED's is divided into two sets, one of which is driven ON, while the other of which is driven OFF for detection. Each set covers a predetermined area. Thus, as the belt moves in the cross process direction, a larger or smaller number of illuminated LED's are optically occluded. If the power drive to the LED sets is toggled between the two sets, a 180° out of phase relationship in intensity will be established between the two sets. By correlating the relative brightness of the sensed illumination with a determination of which LED set is on, then a determination can be made as to which direction the belt hole is displaced from its nominal position.

The sensor output is amplified with an A.C. amplifier, the output of which controls an up/down counter. During the period that a first set of diodes appears brighter, the counter is made to count up. During the period that the second side seems brighter, the counter instead counts down. The counter output status (counting up, or counting down) controls amplitude of the corresponding set of LED's, increasing the brightness of the occluded group, to create an even virtual or sensed brightness, with the result that a position value, indicating the variation in belt position, represented by the contents of the counter is generated. The use of the A.C. component of the illumination signal removes instabilities, drifts, background sensitivities and changing thresholds associated with low level D.C. measurements.

These and other aspects of the invention will become apparent from the following description used to illustrate a preferred embodiment of the invention read in conjunction with the accompanying drawings in which:

FIG. 3A illustrates schematically the sensor driving and location information deriving circuit.

Figures 4A, 4B, 4C:
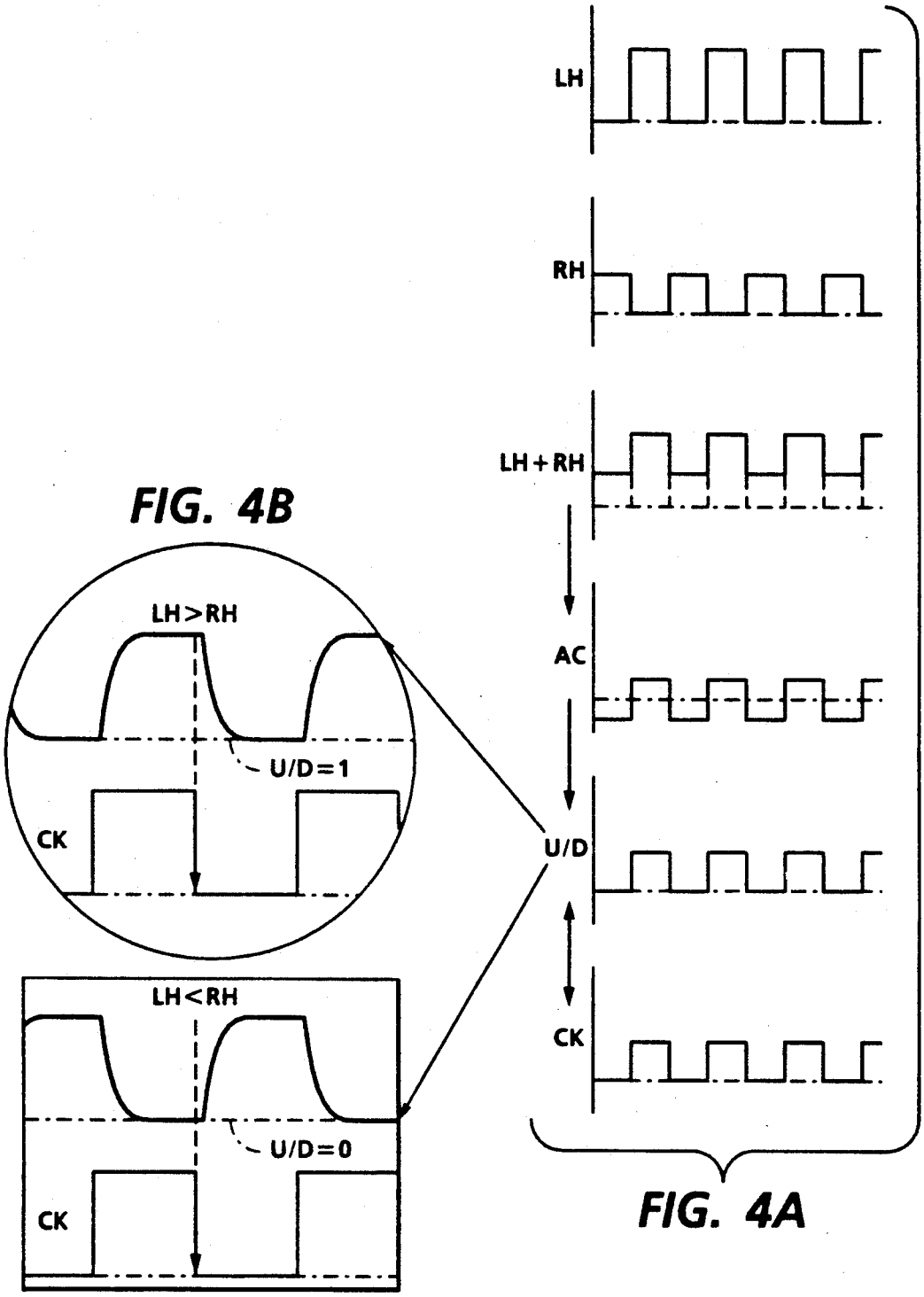
Figure 5:
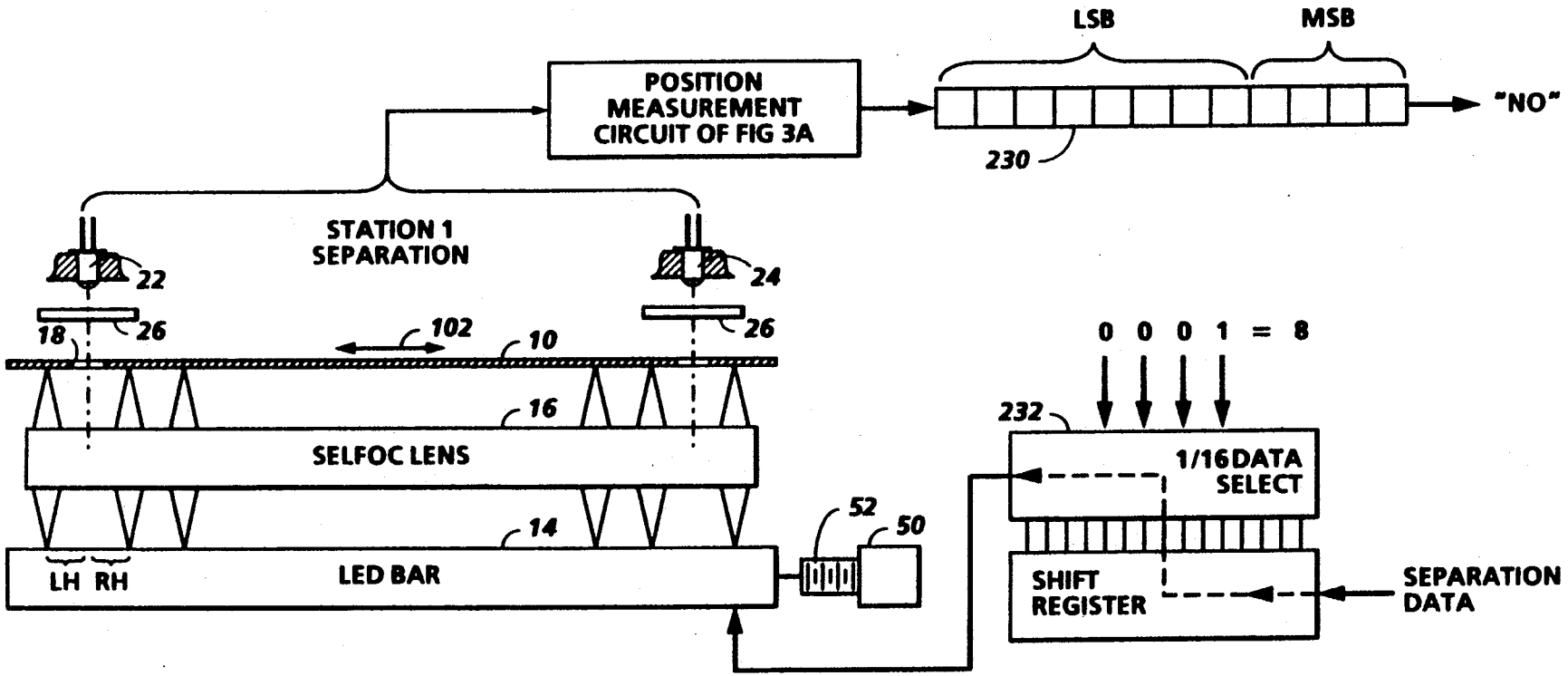

FIGS. 4A, 4B and 4C together illustrate the relative timing sequences of the sensor arrangement; and FIG. 5 illustrates an arrangement and circuit for registering the LED print bar with a belt.

Figure 1:
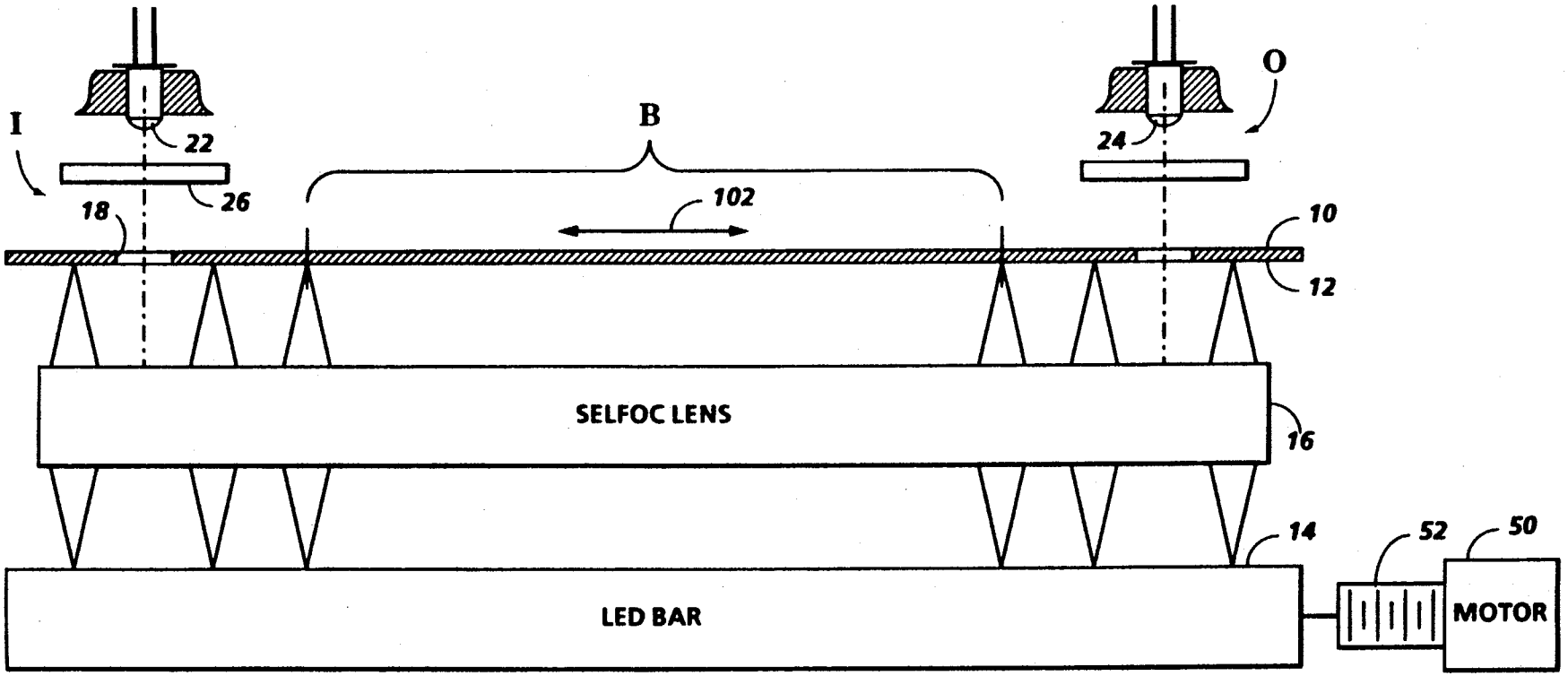
FIG. 1 is a somewhat cross sectional view of an electrophotographic printing machine incorporating the present invention.

Referring now to the drawings, where the showings are for the purpose of describing a preferred embodiment of the invention and not for limiting same, the various processing stations employed in a reproduction machine are well known, and only the portions affected by the present invention are illustrated in FIG. 1.

A reproduction machine in which the present invention finds advantageous use utilizes a photoreceptor belt 10 having a charge retentive surface 12. Belt 10 moves in a direction perpendicular to the plane of FIG. 1 to advance successive portions of the belt sequentially through various processing stations disposed about the path of movement thereof.

At an exposure and position sensing station shown in cross section in FIG. 1, an LED print bar array 14, an array of light emitting diodes arranged in a linear array and extending across the charge retentive surface, transverse to the process direction, may be used as an exposure device. Light from LED print bar array 14 is focused on the charge retentive surface or image supporting surface of belt 10 via a lens 16, that may be bundle of image transmitting fiber lens produced under the trademark of SELFOC by Nippon Sheet Glass Company Ltd. At inboard (I) and outboard (O) edges of belt 10, at least one pair of fiducial holes 18 and 20, are provided, formed in belt 10, and have a diameter or breadth equivalent to the size of several LED's in the array. For precision and simplicity, these holes may be conveniently formed on decals adhesively affixed to the imaging member 10 over a larger hole formed in a belt. This removes the necessity of forming precisely defined mechanical holes in the belt material itself. The decals can be made by any of several processes capable of producing high resolution patterns over small areas, including printing and laser ablation. The decal pattern in a preferred embodiment is in the form of precisely defined transparent area or window, in an otherwise opaque or reflecting background. The window area may or may not have the material of the decal cut out therefrom to form a light transmissive path.

On the reverse side of the belt from the LED print bar array 14 are arranged pair of sensors 22 and 24, each a single, small area sensor, aligned with fiducial holes 18 and 20, well outside the image bearing area B. A light diffusing element 26 may be used as an integrator, to assure that light from the LED's reaches the sensors in a more or less uniform manner, in spite of slight optical misalignments in the positioning of the sensors. Considering one end of the device, LED print bar array 14, lens 16, fiducial hole 18 and sensor 22 are aligned so that a group of LED's direct illumination through the fiducial holes for sensing. The fiducial hole may be a small opening of many shapes or sizes, that accommodates detection of illumination from several LED's. Cutouts or notches at the edge of the belt may also work. Of course, it will be appreciated that while the use of LED's that are integral elements of the led imaging bar are particularly useful in the described invention as a source of illumination for detection by sensors 22 and 24, separate individual light sources conveniently attached in precise linear alignment with the imaging bar elements but outside the active writing span of the imaging bar could also be used.

Figure 2:
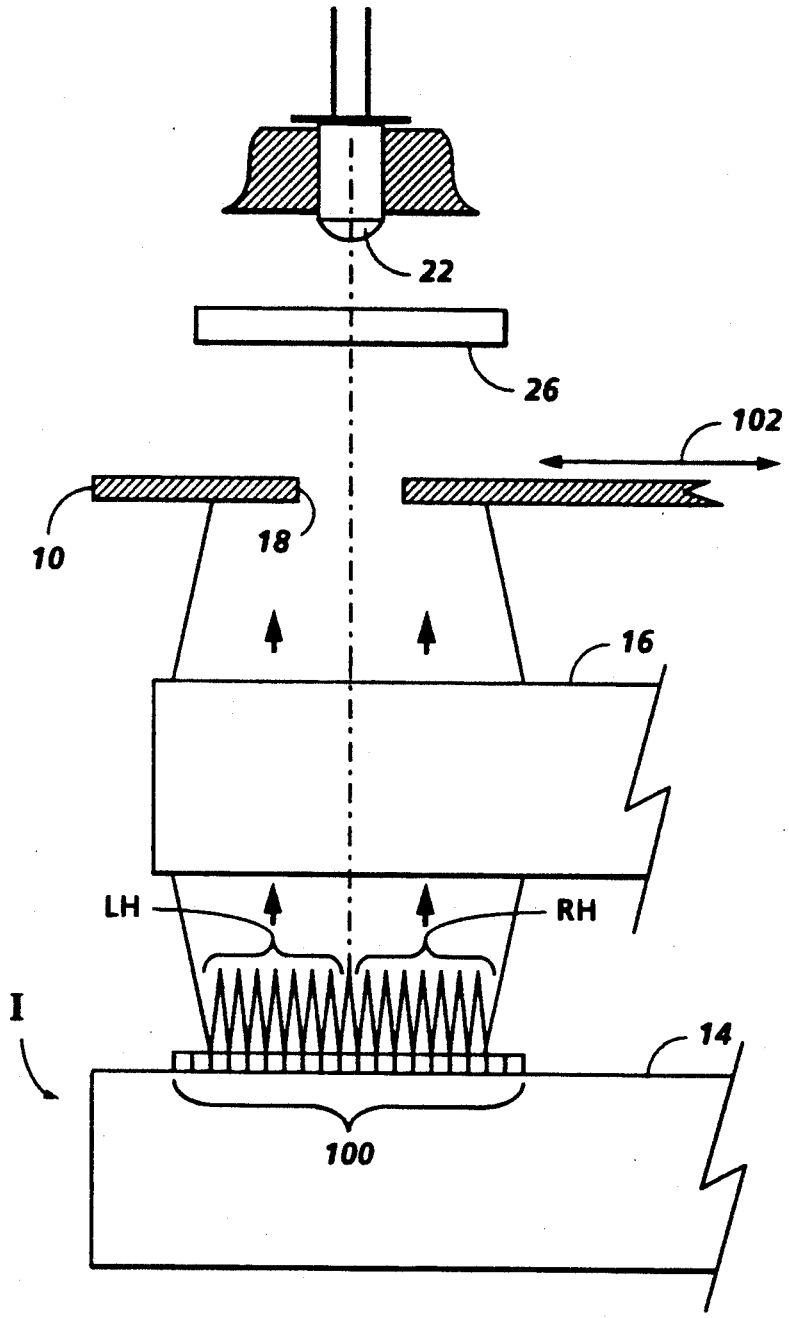
FIG. 2 is an enlarged view of a section of FIG. 1.

With reference now to FIG. 2, the inboard side I of the device is shown in enlargement, and with greater detail. A group 100 of LED's in LED print bar array 14 are selected and driven as sensor LED's aligned with lens 16, fiducial hole 18 and sensor 22. The LED's of group 100 extend in length in the array somewhat longer than the breadth of fiducial hole 18. Sensor 22 is aligned as near to the center of group 100 as conveniently possible.

Group 100 is divided into two sets of LED's, a left hand set (LH) and a right hand set (RH). It can be seen from FIG. 2, that if belt 10 moves in the cross process direction 102, the illumination from different numbers of LED's in each of the sets LH and RH are partially occluded.

With reference now to FIG. 3A, LED's in the sets LH and RH are driven at opposite phases, with pulses from a clock 200 running in the range of about 0.25 to 2.0 MHz, where the frequency of the clock is at least partially dependent on copy sheet speed through the device. Greater or lesser clock rates are not precluded. The clock drives a flip/flop circuit 202, which in turn drives a pair of amplifiers 204 and 206, that drive the LH set and the RH set of LED's ON and OFF in a 180° out of phase relationship. That is to say, when the LED's of LH are ON, the LED's of RH are OFF, and vice versa.

Figures 3B, 3C:
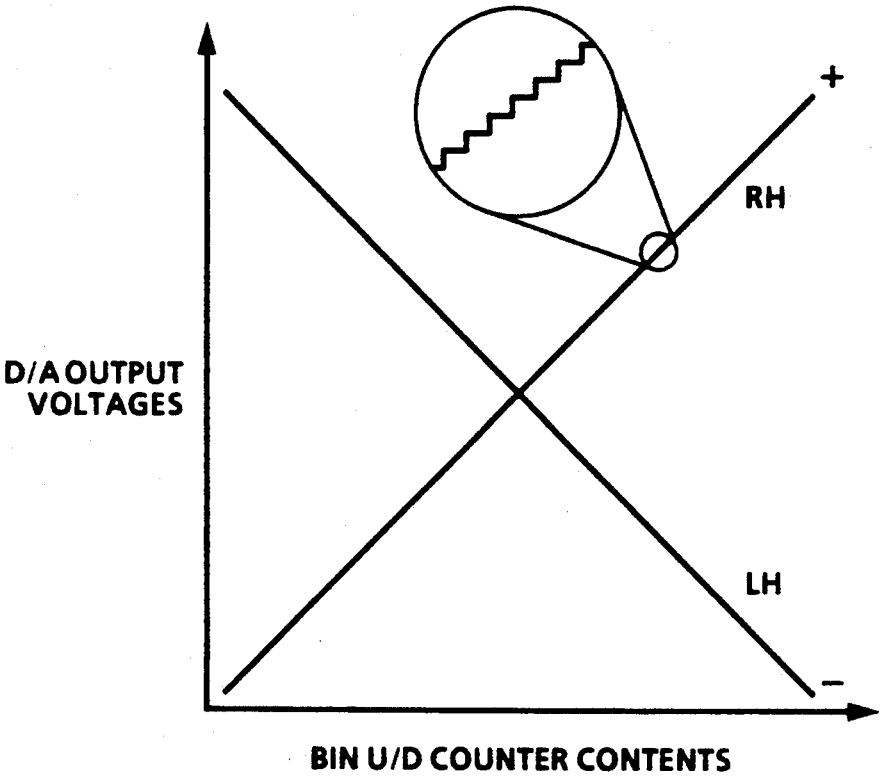
FIGS. 3B and 3C represents the response of the D/A converter compared to the Up down counter contents.

Sensor 22 directs an analog signal representing sensed light intensity (representing light from either the LH set or the RH set) through an A.C. amplifier chain formed by the combination of preamplifier 208, and A.C. amplifier 210, having a fixed, relatively high gain and arranged with respect to capacitor 211 such that only the A.C portion of the signal (reflecting the toggling of the LED's) is detected. A comparator 212 converts the A.C signal to a single digital polarity and amplitude, which controls the direction of a digital up/down counter 214. Up/down counter 214 is incremented/decremented at the rate of toggling of the LED's. If the LH diodes appear brighter than the RH diodes, because the position of fiducial hole 18 causes the RH diodes to be differentially covered, then the up/down counter is incremented one count on each cycle of flip/flop 202. Conversely, if instead the RH diodes appear brighter than the LH diodes, because the position of fiducial hole 18 causes the LH diodes to be differentially covered, then the up/down counter decrements. The digital counter value is directed to a digital to analog converter (D/A) 220, which controls the current in transistors 222 and 224 being supplied to the LED's of set LH and RH, respectively. The D/A has direct and complementary outputs connected respectively to the bases of transistors 222 and 224, so that the signals controlling transistors 222 and 224 vary in accordance with the toggling of the LED's, and particularly, proportionally and in complementary proportion to increasing or decreasing count at the counter. Thus, the value of the count at up/down counter 214 controls the relative intensities of LED sets RH and LH. As counter 214 counts UP, the RH set current increases, and the LH set current decreases, tending to equalize the relative light flux from the two groups sensed by detector 22. The converse is true when the imbalance is reversed and the counter counts down: the LH set current increases, and the RH set current decreases, again tending to equalize the relative light flux sensed by detector 22 from the opposite initial imbalance. When the two values are approximately equal, then the counter will toggle between counting up and counting down, because first one set, and then the other set of LED's appear brighter. The value in the counter at the balance condition can be taken as an indication of the position of the fiducial hole with respect to the symmetry line between LED sets LH and RH. The digital value in the counter changes linearly with the fiducial hole position, with the signal to noise ratio being highest in the center of the span. The value is output from up/down counter 214 to latch 230 indicating output position. The relationship of the D/A response to the up/down counter is shown in FIG. 3B, with the output of the negative output and the positive output compared, of course, the response is a stepwise signal (as shown in FIG. 3C, in the inset).

If counter 214 has an 8 bit output, then the entire contents can be spanned in a range of 256 clock signals or pulses. At 20 inches per second, a one millimeter long hole in the process direction will pass over the LED sets in about 2 milliseconds. Thus, if the clock frequency is at least 128 kHz, there will be enough clock pulses to assure that the balance condition is reached before the hole can travel out of range of the sensing area. Of course, if the clocking speed is high enough, the counter could have an output with a greater number of bits.

The timing diagram of FIGS. 4A, 4B and 4C further illustrate the operation of the device as shown in FIG. 3A. FIG. 4A shows the unequal LH and RH signals, as seen by sensor 22. The signals are effectively added by the sensor for the response of LH+RH. The A.C. signal demonstrates the response of the A.C. amplifier 208. Comparator 210 converts the A.C. signal to the UP/-DOWN logic level (U/D signal) required by up/down counter 214. The CK signal is the clock signal. The position of the leading or trailing edge of the U/D signal with respect to the leading or trailing edge of the CK signal, determines whether the counter is incremented or decremented, as illustrated in the insets FIGS. 4B and 4C, respectively.

In one alternative embodiment of the invention, instead of driving all the LED's in each of the LH and RH sets, the middle LED's of the group are not utilized. This removes the common mode light signal increasing sensitivity to small changes in hole position, since a small change will result in the driven LED's of either the RH or the LH sets being occluded in greater proportion than if all diodes in the groups are utilized.

A secondary advantage of the invention is that it can easily be used to determine lead edge timing through the same circuit. With reference to FIG. 1, as fiducial holes 18 and 20 reach the LED print bar 14 location, the output of amplifier 210 (FIG. 3) will be an increasing value, irrespective of lateral belt position. This value is indicative of timing, or process direction position of the belt. Differences between sensing results at sensors 22 and 24 can be used to determine skew of the belt.

As the output relates linearly to position, and divides 1 millimeter (an example fiducial hole size) into 256 divisions, position sensing resolution is about 4 microns. Accordingly, the position value may be fed back to produce a driving signal to a mechanical actuator such as a stepper motor, indicated by motor 50, in FIG. 1, which can be connected via a lead screw drive system 52, to incrementally move the LED print bar in a direction to minimize the relative positioning error; or to a belt steering mechanism to steer the belt slowly over time in a direction correcting the sensed misalignment; or to an image processing system of the printer to offset the image by one or more pixels. A one pixel shift may be a large enough increment to notice, and accordingly either mechanical or a combination of mechanical and electronic correction methods are preferred. While the above measurement can be accomplished on the fly, it might also be accomplished on selected diagnostic cycles when no imaging is occurring.

One possible embodiment for registration using the above described arrangement, illustrated in FIG. 5, may be implemented as follows. A digital value N stored in latch 230 is scaled or normalized to a 12 bit value so that the least significant bits (say, the eight least significant bits) represent fractional pixel distances, while the most significant bits (say, the four most significant bits) represent whole pixel distances. The four most significant bits (illustrated as the four right most bits for drawing clarity) control a shift register in the image data path for each separation of a color image. The value of the four most significant bits of N determine how many bits must be shifted at the shift register, before directing the data to the LED print bar. This is essentially a pixel shift, by an integer number of pixels. Then, the eight least significant bits are used as data to control a motor controller (not shown) for motor 50 and lead screw arrangement 52. Preferably, the least significant bits represent one pixel width of correction, divided into 256 increments. Perfect alignment would preferably be represented by the integer 128 (irrespective of pixel offset). Accordingly, starting at some initial slightly misaligned position corresponding to the counter contents N, the numerical difference (N−128) equals the number of steps (or sub multiple thereof) needed to move the led print bar back into proper registration or alignment.

In the embodiment shown in FIG. 5, the print bars actively seek realignment with the fiducial hole on each passage. A slowly but constantly drifting belt implies that the print bar is constantly in motion, in effect chasing the belt as it moves from side to side. Accordingly, in a slightly different embodiment, where multiple print bars and registration systems are used, a first print bar may be fixed in position (except possibly at device start up) and used thereafter to determine the dynamic position of the fiducial hole. Then, succeeding print bars are moved to match the position error sensed for the reference print bar. Since error associated with belt wander will be small, especially if the drift is corrected very slowly, the print bar actuations associated with this differential correction embodiment should be very small.

The invention has been described with reference to a preferred embodiment. Obviously modifications will occur to others upon reading and understanding the specification taken together with the drawings. This embodiment is but one example, and various alternatives, modifications, variations or improvements may be made by those skilled in the art from this teaching which are intended to be encompassed by the following claims.

I claim:

1. In an imaging device having a belt member with an image supporting surface moving along an endless path in a process direction, an exposure device for forming images on the image supporting surface, and means for maintaining the belt in registration with the exposure device, said registration means comprising:

said belt member provided with at least one fiducial opening formed therein;

a sensor disposed with respect to said belt member and said fiducial opening, to sense illumination directed through the fiducial opening in said belt member;

means at a fixed position with respect to said exposure device and said sensor for directing illumination therethrough, including at least first and second independently detectable illumination sources arranged along a cross process direction;

means for determining, from sensed illumination, belt position with respect to the exposure device from the amount of occlusion of one of said first and second independently detectable illumination sources.

2. The device as defined in claim 1, wherein the belt member has an area of the imaging supporting surface within which images are formed, and said fiducial opening is formed on said belt member, outside said area.

3. The device as defined in claim 1, wherein the sensor is disposed at a fixed position with respect to said exposure device.

4. The device as defined in claim 1, wherein said illumination directing means is a light source.

5. The device as defined in claim 1, wherein said exposure device includes an array of light sources individually drivable form an image on the imaging surface.

6. The device as defined in claim 5, wherein said illumination directing means, is a plurality of light sources in said array of light sources.

7. The device as defined in claim 6, wherein said at least first and second independently detectable illumination sources are complementary subsets of the plurality of light sources.

8. In an imaging device having a belt member for supporting images on an image supporting surface moving along an endless path in a process direction, an exposure device including a linear array of light sources for forming images on the image supporting surface, said array extending transversely across the belt, perpendicular to the process direction, and means for maintaining the belt in registration with the exposure device, said registration means comprising:

said belt member provided with at least one fiducial opening formed therein;

at least one sensor disposed with respect to said belt member and said at least one fiducial opening, to sense illumination directed through the fiducial opening in said belt member;

means for driving a group of light sources in said array to direct light through said fiducial opening for detection by said sensor, said group of sensors including at least two sets of light sources, each set independently drivable with respect to the other and detectable by said sensor;

means for determining, the amount of illumination from sensed illumination, the amount of illumination directed through said fiducial opening by each set;

means for determining belt position with respect to the exposure device from the relative amounts of illumination at said sensor received from each of said first and second sets.

9. The device as defined in claim 8, wherein the belt member has an area of the imaging supporting surface within which images are formed, and said fiducial opening is formed on said belt member, outside said area.

10. The device as defined in claim 8, wherein the sensor is disposed at a fixed position with respect to said exposure device.

11. In an imaging device having a belt member for supporting images on an image supporting surface moving along an endless path in a process direction, an exposure device including a linear array of light sources for forming images on the image supporting surface, extending transversely across the belt, perpendicular to the process direction, and means for maintaining the belt in registration with the exposure device, said registration means comprising:

said belt member provided with at least one fiducial opening formed therein;

at least one sensor disposed with respect to said belt member and said at least one fiducial opening, to sense illumination directed through the fiducial opening in said belt member;

means for driving a group of light sources in said array to direct light through said fiducial opening for detection by said sensor, said group of sensors including at least two sets of light sources, each set independently drivable and detectable by said sensor;

means for determining the amount of illumination directed through said fiducial opening by each set;

means for controlling said driving means in response to sensed illumination for incrementally varying the illumination of one of said sets, until illumination from each set is equal, said incremented amount a value that is linearly related to belt position with respect to the exposure device.

12. The device as defined in claim 11, wherein the belt member has an area of the imaging supporting surface within which images are formed, and said fiducial opening is formed on said belt member, outside said area.

13. The device as defined in claim 11, wherein the sensor is disposed at a fixed position with respect to said exposure device.

14. The device as defined in claim 11, where said controlling means incrementally varies the illumination of the other of said sets concurrently with variation of said one of said sets.

15. In an imaging device having a belt member for supporting images on an image supporting surface moving along an endless path in a process direction, an exposure device including a linear array of light sources for forming images on the image supporting surface, extending transversely across the belt, perpendicular to the process direction, and means for maintaining the belt in registration with the exposure device, said registration means comprising:

said belt member provided with at least one fiducial opening formed therein;

at least one sensor disposed with respect to said belt member and said at least one fiducial opening, to sense illumination directed through the fiducial opening in said belt member, said sensor producing an output indicative of sensed light intensity;

a group of light sources in said linear array arranged to direct light through said fiducial opening for detection by said sensor, said group of light sources including at least two sets of light sources, each set independently drivable and detectable by said sensor;

means for independently driving said light sources, so that each set is periodically in an ON condition while the other set is in an OFF condition;

a counter, for counting pulses from said sensor output indicative of the inequality of illumination of each of the sets of light sources, caused by belt occlusion thereof, and producing a pair of count values indicative of light sensed from each of the sets;

a converter using said count values to vary, incrementally, by preselected amounts, the operation of said independent driving means, to vary the illumination from each of said sets, until illumination from each set is equal, said increment amount a value that is linearly related to belt position with respect to the exposure device.

16. The device as defined in claim 15, wherein the belt member has an area of the imaging supporting surface within which images are formed, and said fiducial opening is formed on said belt member, outside said area.

17. The device as defined in claim 15, wherein the sensor is disposed at a fixed position with respect to said exposure device.

18. In an imaging device having a belt member with an image supporting surface moving along an endless path in a process direction, an exposure device for forming images on the image supporting surface responsive to data directed thereto on a line at a time basis, and means for maintaining the belt in registration with the exposure device, said registration means comprising:

means to derive a value indicative of belt position with respect to the exposure device:

means to divide the value into integer pixel increments and fractional pixel increments;

means for offsetting data by integer pixel increments of said value; and means for moving said exposure device relative to said belt by fractional pixel increments of said value.

19. The devices as defined in claim 18, where the value deriving means includes:

said belt member provided with at least one fiducial opening formed therein;

a sensor disposed with respect to said belt member and said fiducial opening, to sense illumination directed through the fiducial opening in said belt member;

means at a fixed position with respect to said exposure device and said sensor for directing illumination therethrough, including at least first and second independently detectable illumination sources arranged along a cross process direction;

means for determining, from sensed illumination, a value representative of belt position with respect to the exposure device from the amount of occlusion of one of said first and second independently detectable illumination sources.

20. The device as defined in claim 18, wherein said means for offsetting data by integer pixel increments of said value is a shift register.

* * * * *